US005390589A

United States Patent [19]

Satake et al.

[11] Patent Number: 5,390,589

[45] Date of Patent: Feb. 21, 1995

[54] VERTICAL PEARLING MACHINES AND APPARATUS FOR PRELIMINARY TREATMENT PRIOR TO FLOUR MILLING USING SUCH PEARLING MACHINES

[75] Inventors: Satoru Satake, Tokyo; Takeshi Ishii; Yoshihiro Tokui, both of Hiroshima, all of Japan

[73] Assignee: Satake Corporation, Tokyo, Japan

[21] Appl. No.: 293,212

[22] Filed: Aug. 19, 1994

[30] Foreign Application Priority Data

Oct. 1, 1993 [JP] Japan ..... 5-269952

[51] Int. Cl.[6] ..... B02B 3/00; B02B 7/02

[52] U.S. Cl. ..... 99/519; 99/521; 99/524; 99/608; 99/611; 99/613

[58] Field of Search ..... 99/518, 519–524, 99/525–528, 600–608, 609–618, 621, 622, 623; 426/481–483; 241/57, 58, 74, 257.1, 260.1

[56] References Cited

U.S. PATENT DOCUMENTS

| | | | |
|---|---|---|---|
| 4,133,257 | 1/1979 | Satake | 99/613 |
| 4,515,075 | 5/1985 | Satake | 99/611 X |
| 4,583,455 | 4/1986 | Salete-Garces | 99/608 X |
| 4,829,893 | 5/1989 | Satake | 99/524 X |
| 4,843,957 | 7/1989 | Satake | 99/519 |
| 5,076,157 | 12/1991 | Satake | 99/613 X |
| 5,119,721 | 6/1992 | Satake et al. | 99/519 |
| 5,259,303 | 11/1993 | Yamamoto et al. | 99/524 X |
| 5,295,629 | 3/1994 | Satake et al. | 241/57 |

FOREIGN PATENT DOCUMENTS 2-184347 2/1990 Japan .

*Primary Examiner*—Timothy F. Simone
*Attorney, Agent, or Firm*—Fish & Richardson

[57] ABSTRACT

A pearling machine has an abrasive type pearling roll assembly which is formed by stacking a plurality of pearling rolls via intervening air blowing spacers. Stirring bars are secured to the outer periphery of the individual pearling rolls. Resistance bars are provided on the inner surface of a vertical polygonal bran removal cylinder. With a cooperative function of the stirring and resistance bars, grains supplied to a pearling chamber defined by the pearling roll assembly and the bran removal cylinder receive active spinning and revolution action. The grains thus receive uniform cutting action, and thus they are pearled uniformly. The vertical pearling machine permits optimum pearling of grains in dependence on the kind and character of the grains and is suited particularly to the pearling of tempered wheat with outer layer part having been made tough and inner layer part having been made soft.

14 Claims, 6 Drawing Sheets

VERTICAL PEARLING MACHINES AND APPARATUS FOR PRELIMINARY TREATMENT PRIOR TO FLOUR MILLING USING SUCH PEARLING MACHINES

BACKGROUND OF THE INVENTION

1. Field of the Invention

This invention relates to a vertical pearling machine for pearling wheat or like grains and also to an apparatus for preliminary treatment for flour milling using a plurality of such vertical pearling machines connected in tandem.

2. Description of the Related Art

In a broadly practiced method of producing wheat flour, the raw wheat which has been cleaned and conditioned is directly broken without its bran part being removed, and its endosperm part (about 84% by weight) which is to be eventual product flour is separated from its bran part (13.5% by weight) and its germ part (2.5% by weight), these bran and germ parts being undesired as contents in the product flour. The introduction of the bran part which contains much ash deteriorates the quality of the product flour, and therefore the content of this part should be made as little as possible. To this end, prior to the flour milling, the row material is conditioned with water or steam and then tempered in a tempering bin for 4 to 20 hours for making each wheat grain bran layer tough and the endosperm soft.

By carrying out these preliminary treatments prior to the flour milling process, the flour milling characteristics are generally improved. Depending on the tempering time, however, the coupling between the endosperm and the inner bran layer is rather strengthened to make the separation of the endosperm and bran parts difficult. In view of this problem, a technique of removing the bran, which is undesired to be contained in the product flour, prior to the flour milling, has been proposed as disclosed in, for instance, Japanese Patent Application Kokai Publication No. Hei 2-184347. This prior art will now be described with reference to the flow chart of FIG. 1.

As shown in the Figure, the cleaned raw wheat A is first fed to a water additioner 101 for adding a slight amount of water to soften its bran. Then, it is immediately pearled in a pearling process 106, which is constituted by a tandem connection of friction units (i.e., friction type pearling machines) 102 and 103 and abrasive units (i.e., abrasive type pearling machines) 104 and 105. While the material is pearled, further water is added to moisten the material surface. The pearled wheat B thus obtained is fed through a wiper 107 and a cooler 108 to a further water additioner 109 for further water addition to obtain conditioned pearled wheat C containing about 16% of water by weight.

In the above prior art, however, since water is added to the pearled wheat obtained after the pearling process 106, the starch layer of the wheat may be dissolved to result in sticking of wheat grains to one another into masses. A large-scale stirrer, therefore, has been necessary to prevent the mutual sticking of wheat grains.

To solve this problem, it may be thought to moisten and temper the material wheat prior to the pearling thereof. By moistening, however, the wheat bran is made tough as noted above. In this condition, the pearling does not proceed sufficiently with the conventional grinding type pearling machine. In addition, since the endosperm part is softened, a large amount of breakage occurs in the friction type pearling machine.

SUMMARY OF THE INVENTION

It is, therefore, an object of the invention to provide a pearling machine, which can pearl even moistened and tempered raw wheat, and an apparatus for preliminary treatment prior to flour milling using a plurality of such pearling machines connected in tandem.

According to the invention, to solve the above problems, there are provided the following technical means in a pearling machine, which comprises a vertical polygonal bran removal cylinder including a plurality of support posts and bran removal nets or walls each stretched between adjacent ones of the support posts, a main shaft erected rotatably within the bran removal cylinder, an abrasive type pearling roll assembly mounted on an upper portion of the main shaft, the pearling roll assembly having an outer periphery having a circular sectional profile and having a grinding surface provided over the entire circumference, and a grain feeding screw roll connected to the pearling roll assembly, the space between the bran removal cylinder and the abrasive type pearling roll assembly being a main part of a pearling chamber, which have one axial end communicated with a grain feed section and the other axial end communicated with a grain discharge section, an outer cylinder being disposed such as to surround the bran removal cylinder and define a bran removal chamber. The technical means noted above are:

a) The abrasive type pearling roll assembly is formed with a plurality of pearling rolls.
b) The pearling rolls are stacked one over another via intervening air blowing spacers each having an air blow port.
c) The outer periphery of the pearling rolls is formed with a plurality of vertical grooves, and stirring bars are fitted therein.
d) Resistance bars are provided on the inner surface of the bran removal cylinder and along the borderline between adjacent bran removal walls.
e) The resistance bars are removably secured to the support posts such as to push the bran removal walls thereagainst, and the stirring bars are removably secured to the air blowing spacers.

The extent of projection of the resistance and stirring bars into the pearling chamber is made variable or adjustable by fitting these bars on the polygonal bran removal cylinder or the abrasive type pearling roll assembly via spacers or providing replacement bars.

Each stirring bar may be mounted such that its vertically extending chamfer is found on the forward side in the rotational direction of the pearling roll assembly and that its vertically extending edge portion (rising portion) is found on the other side, and also it may be mounted invertedly, i.e., upside down.

Further, preferably a plurality of pearling machines having the above structure are connected in tandem to provide an apparatus for preliminary treatment prior to flour milling or breaking, i.e., pearling the moistened and tempered wheat prior to the flour milling or breaking.

In the pearling machine according to the invention, the resistance bars are provided axially on the polygonal bran removal cylinder inner surface, while the stirring bars are provided vertically on the outer periphery of the abrasive type pearling roll assembly comprising a plurality of pearling rolls, the stirring bars being mounted on the air blowing spacers intervening between adjacent pearling rolls, the resistance bars being mounted on the bran removal walls. Thus, the grains in the pearling chamber are adequately stirred to undergo active spinning and revolution to strike the peripheral surface of the pearling rolls in multiple directions and highly frequently and thus receive cutting action. Thus, the pearling machine permits uniform pearling of the process grains as a whole and is suited for pearling particularly hard grains.

Further, the extent of projection of the stirring and resistance bars into the pearling chamber is variable or adjustable either by securing the bars via spacers or mounting replacement bars. Thus, it is possible to vary the inner pressure in the pearling chamber or the stirring action in dependence upon the kind or character of grains, thus permitting optimum pearling of material grains.

Further, since each of the stirring bars is provided on either forward or rearward side in the rotational direction of the pearling roll assembly with the vertically extending chamfer, and is provided on the other side with the rising portion, by mounting stirring bar such that the chamfer is on the forward side in the rotational direction noted above, a comparatively gentle stirring action is obtainable, while by mounting them upside down so that the rising portion is found on the forward side in the rotational direction, an active stirring action can be obtained. Thus, where a plurality of such pearling machines are connected in tandem for use, by suitably setting the orientation of the stirring bars it is possible to realize both pearling of a comparatively gentle pearling action by the abrasive system and pearling of an active stirring action by the frictional system with the same pearling machine system.

Further, by using the pearling machines according to the invention in the above status in an apparatus for preliminary treatment prior to flour milling, it is possible to pearl even tempered wheat with the bran made tough by moistening and tempering and obtain pearled wheat free from masses of grains stuck together. Further, although the use of pressure system frictional type pearling rolls is liable to result in breakage of softened pearled wheat grains, this can be prevented by removing the bran of the wheat grains with the abrasive type pearling rolls accompanying a stirring action.

BRIEF DESCRIPTION OF THE DRAWINGS

The above and other objects, features and advantages of the present invention will be apparent from the following description of preferred embodiments of the invention explained with reference to the accompanying drawings, in which.

PREFERRED EMBODIMENTS OF THE INVENTION

Now, a preferred embodiment of the pearling machine according to the invention will be described in conjunction with the case of pearling wheat as grains with reference to FIGS. 2 to 5.

Figure 1:
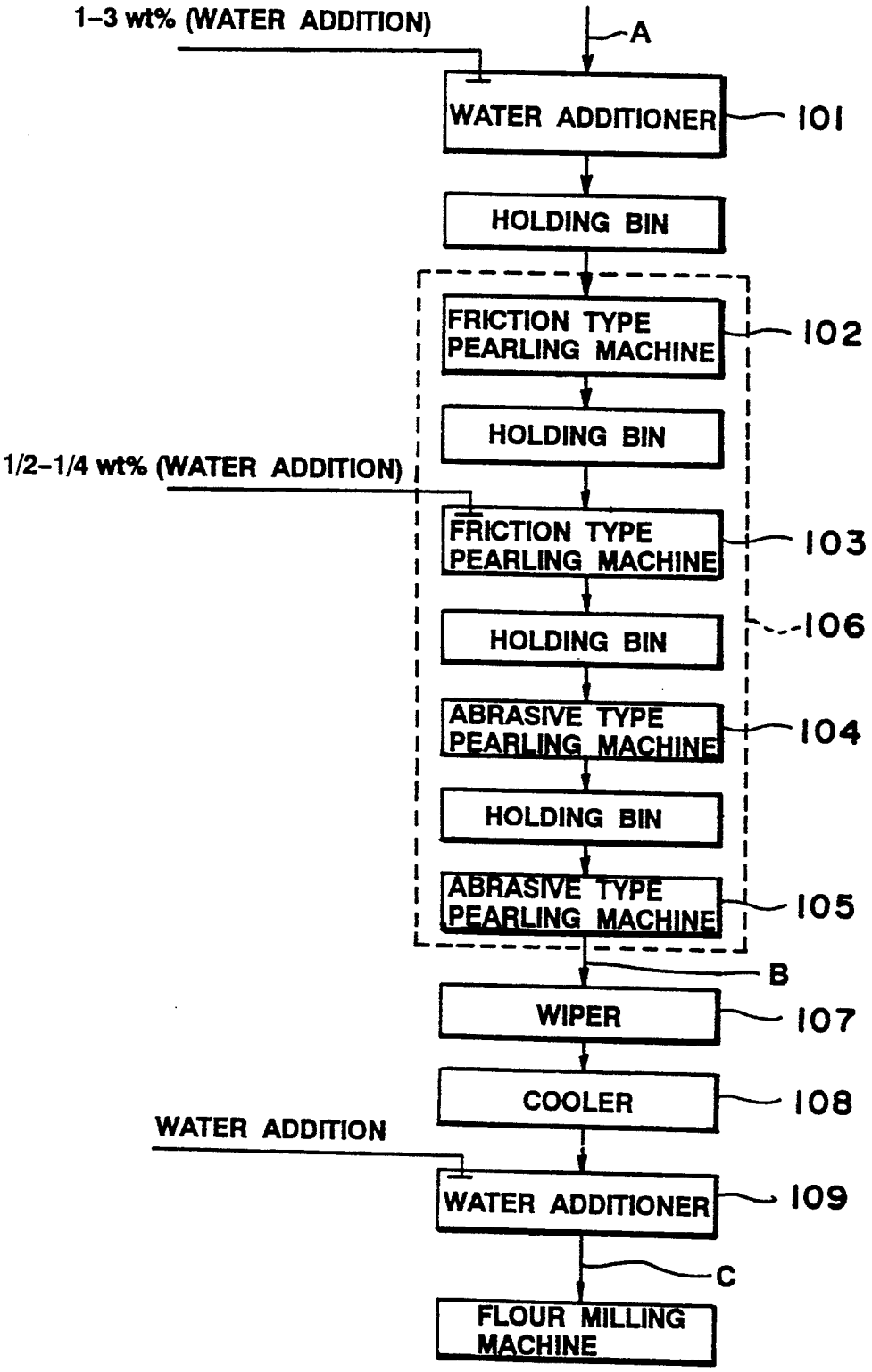
FIG. 1 PRIOR ART
FIG. 1 is a flow chart concerning a method of and an apparatus for a preliminary treatment prior to flour milling in the prior art.
Figure 2:
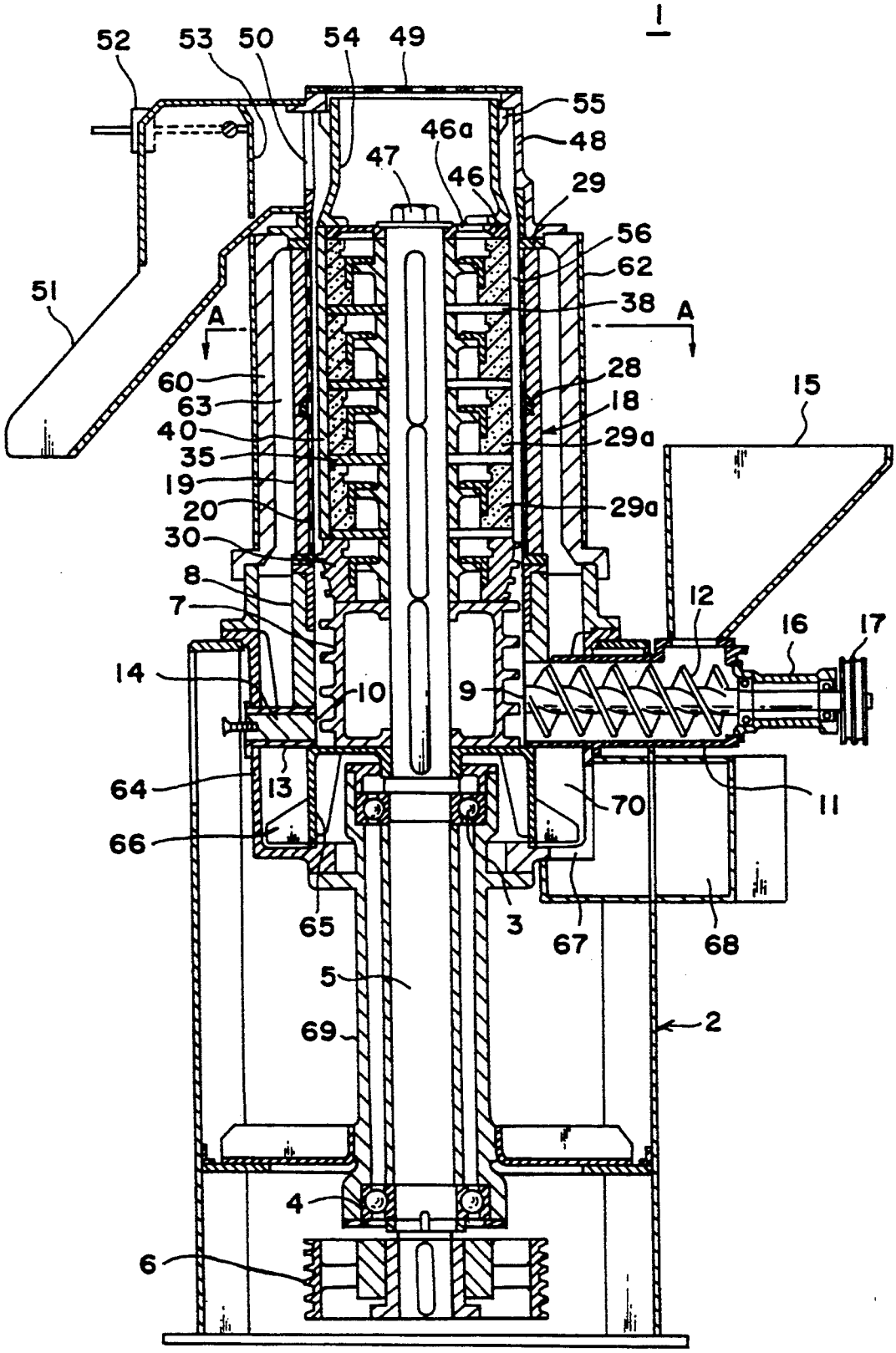
FIG. 2 is a sectional view showing a preferred embodiment of the pearling machine according to the invention.
Figure 3:
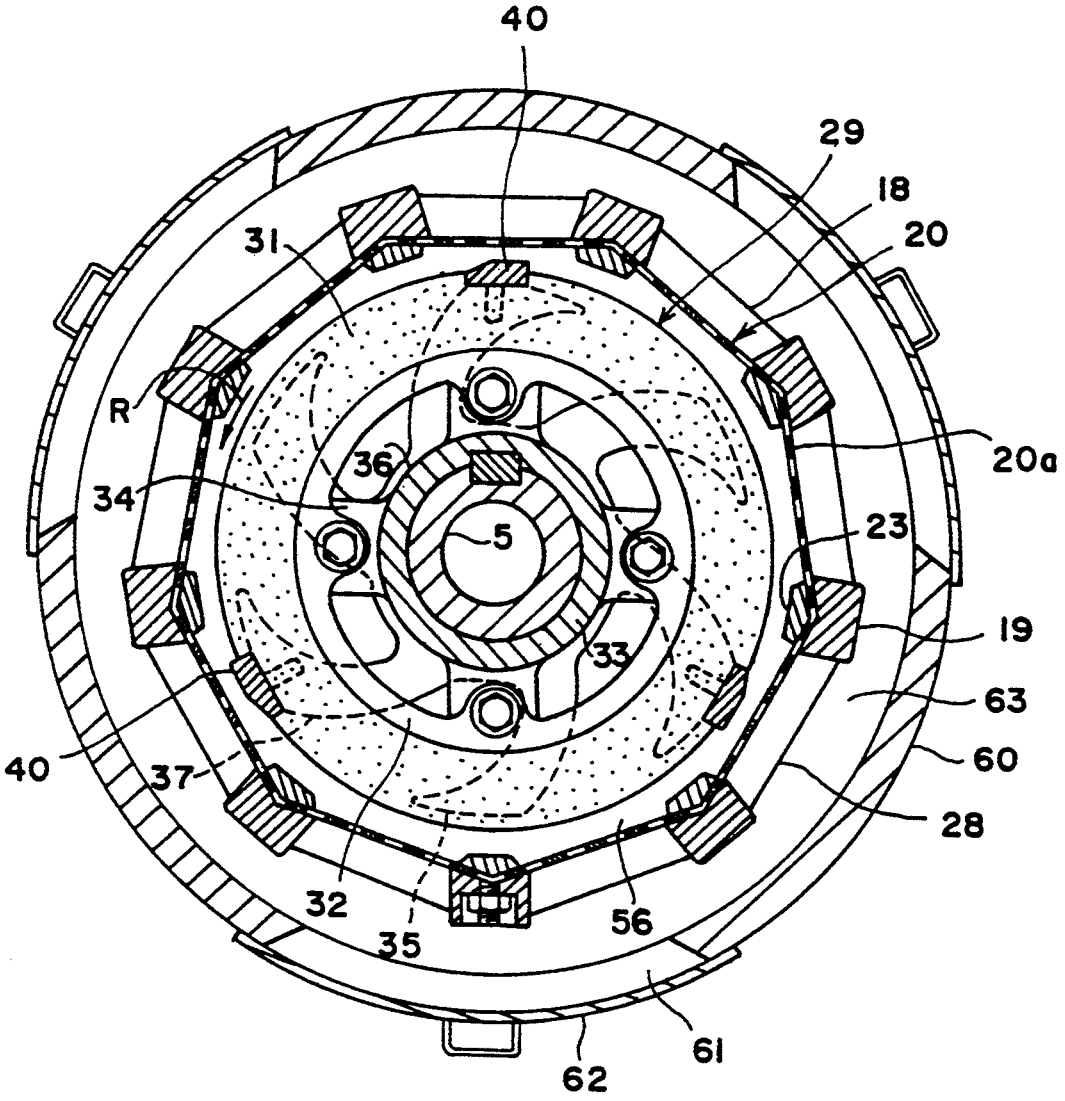
FIG. 3 is a sectional view taken along a line A—A in the pearling machine shown in FIG. 2.

FIG. 2 is an overall sectional view showing the pearling machine 1. Referring to the Figure, reference numeral 2 designates a machine base. A bearing cylinder 69 is mounted upright in the machine base 2 substantially at the center thereof. Supported in the bearing cylinder 69 are an upper and a lower bearing 3 and 4, in which a hollow main shaft 5 is supported rotatably. A pulley 6 is provided at the lower end of the main shaft 5, and it is coupled to a motor (not shown) by a V-belt (not shown) for rotating the main shaft 5 at an adequate rotational speed. The main shaft 5 has an upper half projecting upward from the base 2.

Above the upper bearing 3 for supporting the main shaft 5, a screw roll 7 for feeding grains is rotatably mounted, and a feed cylinder 8 is disposed such that it surrounds the screw roll 7. The peripheral wall of a bottom portion of the feed cylinder 8 has a grain feed port 9 and a residual grain take-out port 10. To the grain feed port 9 is connected one end of a conveyor case 11 such that an end of a feed screw 12 in the direction of feed faces the grain feed port 9. A feed hopper 15 is connected to the other end of the conveyor case 11 corresponding to the feed start end of the feed screw 12. The feed screw 12 is supported in a bearing section 16 in a cantilever fashion and is coupled via a pulley 17 and a V-belt (not shown) to a motor (not shown). To the residual grain take-out port 10 is connected a residual grain take-out cylinder 13, in which a plug 14 is fitted.

A cage-like bran removal wall support frame 18 is disposed on the upper end of the feed cylinder 8. The support frame 18 includes, for instance, nine support posts 19 (see FIG. 3). Each support post 19 is formed on the side nearer the main shaft 5 with a notch 21 having a valley-like sectional profile (with a valley angle of 140° in this embodiment) (see FIG. 4). A bran removal wall **20*a* is stretched between adjacent support posts 19 with its edges in contact with the surfaces of the notches 21 of the support posts 19, thus forming a nine-sided polygonal bran removal cylinder 20. A resistance bar 23 having a ridge 22 of a hill-like sectional profile complementary to that of the notch 21 (see FIG. 4) is secured to each support post 19 by pushing intervening edges of adjacent bran removal walls 20*a* against the support post 19. The means of securement, as shown in detail in FIG. 4, includes a stud 24, which has one end portion embedded in the resistance bar 23 and the other end portion extending through the gap between the adjacent bran removal walls 20 and penetrating a hole 25 formed in the support post 19. A nut 26 is tightened on a portion of the stud 24 extending in a recess 27 formed on the side of the support post 19 opposite the notch 21. Suitably, a plurality of studs 24 may be provided for each support post 19, and reinforcement beam members 28 (see FIG. 3) are provided such that they each connect adjacent support posts 19** at an intermediate position thereof.

Figure 4:
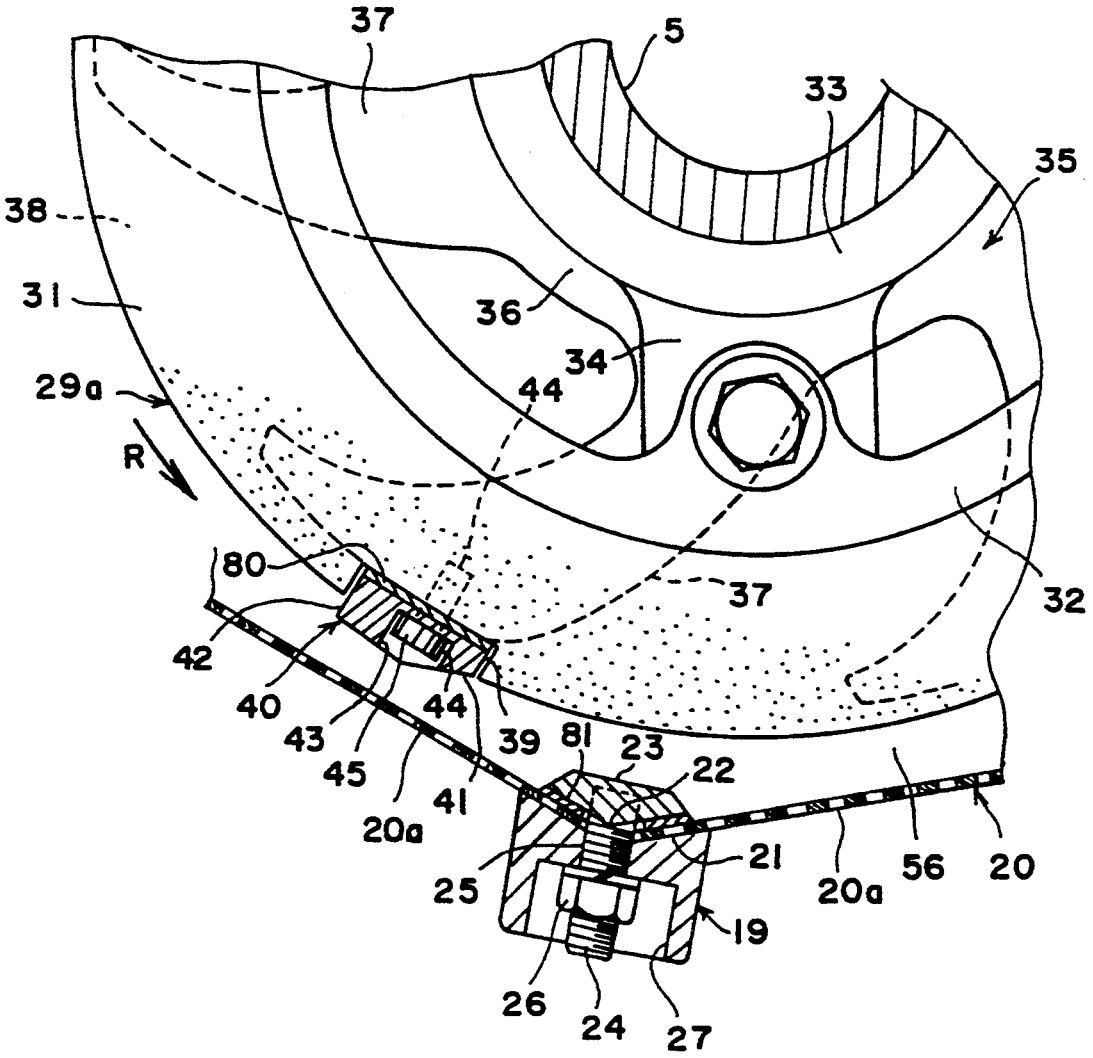
FIG. 4 is a fragmentary enlarged-scale sectional view showing a part of FIG. 3.

Inside the polygonal bran removal cylinder 20, an abrasive type pearling roll assembly 29 is mounted on the main shaft 5. An auxiliary screw roll 30 is interposed between the pearling roll assembly 29 and the screw roll 7. The pearling roll assembly, as shown in FIG. 2 for instance, is formed by stacking four pearling rolls 29*a* one over another. Each pearling roll 29*a*, as shown in FIG. 4, includes a ring-like abrasivestone 31 having an abrasive edge over the entire circumference, a rim 32 supporting the abrasivestone 31, a boss 33, and arms 34 connecting the rim 32 and the boss 33 to each other. A pearling chamber 56 is formed between the outer periphery of the abrasivestones 31 and the bran removal cylinder 20.

Spacers 35 for air blowing are each interposed between adjacent pearling rolls 29*a*. Each spacer 35 includes a central boss 36 mounted on the main shaft 5 and a plurality of arms 37 radially outwardly extending from the boss 36. Each arm 37 is bent rearwardly in the direction of rotation of the pearling roll assembly 29 (see arrow R) for preventing intrusion of grains, and an air blowing port 38 is formed between the ends of adjacent arms 37.

The outer periphery of each pearling roll 29*a* has three, uniformly spaced-apart vertical grooves 39. A stirring bar 40 is fitted in each groove 39. The stirring bar 40 has a length substantially equal to the height of the abrasive type pearling roll assembly 29. It has a vertical chamfer 41 on the forward or rearward side in the direction of rotation of the pearling roll assembly 29 (see FIG. 4). On the side opposite to the side of the chamfer 41, the stirring bar 40 has a 90-degree rising portion 42. The stirring bar 40 is secured to each spacer 35 by a bolt 45, which is inserted through a recess 43 and a hole formed in it at a position corresponding to the spacer 35 and screwed in a female thread 44 formed in an arm 37 of the spacer 35. The upper end of each stirring bar 40 is bolted to the edge of a retainer plate 46 in the same way as the securing to the spacer 35 by a bolt 45, by which the individual pearling rolls 29*a* are fastened with a bolt 47 from above to the upper end of the main shaft 5 (see FIG. 2). Each stirring bar 40, which is fitted in each groove 39 and secured, is formed such that it can be removed from the groove 39 and fitted again upside down in the groove 39. With the stirring bar 40 fitted upside down in the groove 39, its chamfer 41 is found rearward in the rotational direction R of the pearling roll assembly 29 and its rising portion 42 forward in the rotational direction R.

Referring back to FIG. 2, a discharging cylinder 48 is provided on the upper end of the bran removal wall support frame 18. A perforated cover 49 is provided on the upper surface of the discharging cylinder 48. The discharging cylinder 48 has its peripheral wall formed with a pearled grain discharge port 50. A slanted discharging chute 51 is connected to the discharge port 50. A resistance plate 53 is pivotably mounted in the discharging chute 51. The discharging plate 53 is constantly biased by a weight 52 toward the discharge port 50. A hollow upper rotary cylinder 54 is provided on the retainer plate 46 at the upper end of the pearling roll assembly 29. The rotary cylinder 54 has a plurality of pawls 55 provided on an upper portion of its outer peripheral surface.

Now, bran removal means will be described. An upper outer cylinder 60 is disposed to surround the bran removal wall support frame 18 at a predetermined distance therefrom, thus forming a bran removal chamber 63. The upper outer cylinder 60 is supported on the machine base 2. Its peripheral wall is provided with a plurality of inspection windows 61 (see FIG. 3), which are each closed by a cover 62 with a grip. A lower outer cylinder 64 is connected to the lower end of the upper outer cylinder 60. The lower outer cylinder 64 has its bottom portion connected to the bearing cylinder 69. A lower rotary cylinder 65 is rotatably disposed in the bottom portion noted above, and it is connected to the lower end of the screw roll 7. The lower rotary cylinder 65 has a plurality of vanes 66 provided on a lower end portion of its outer peripheral surface. The lower outer cylinder 64 has its bottom portion provided with a bran discharge port 67, thus forming a bran collection chamber 70. A bran duct 68 is connected to the bran discharge port 67. The bran duct 68 is coupled to a fan and a bag filter (both being not shown).

Figure 6:
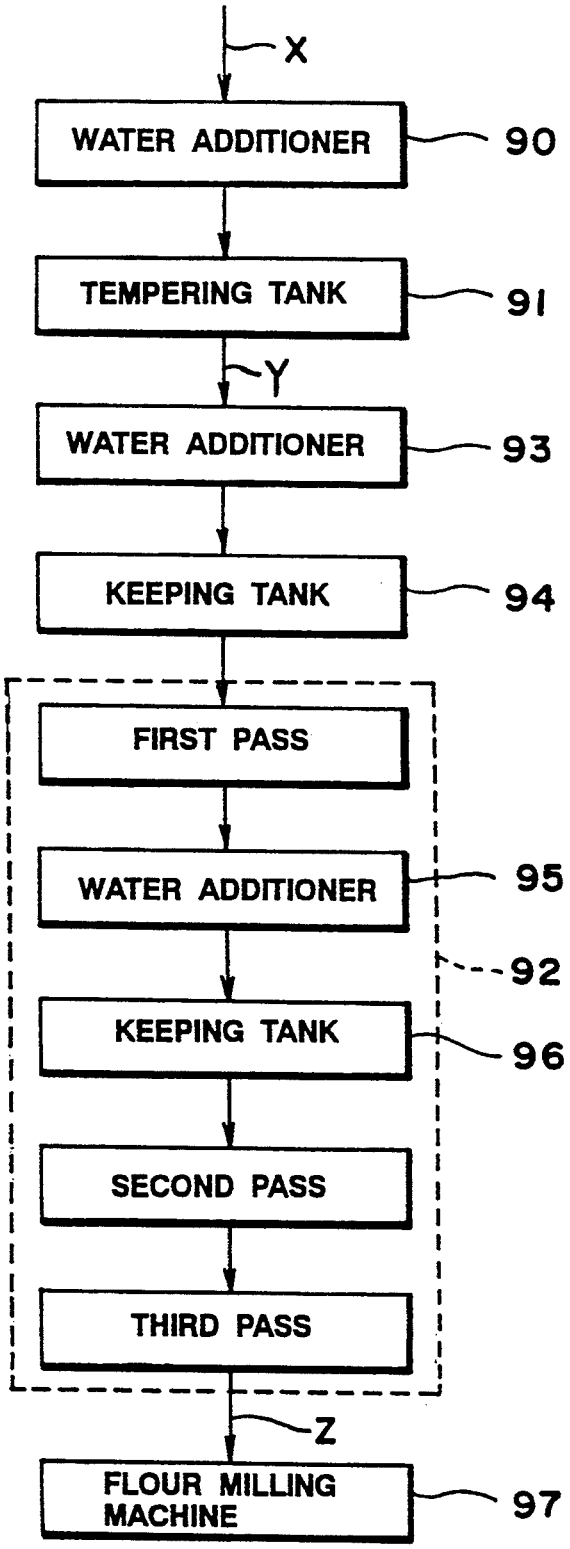
FIG. 6 is a flow chart concerning the apparatus for preliminary treatment prior to flour milling in a preferred embodiment of the invention.

Now, a specific operation of the pearling machine 1 in the above embodiment when used in a preliminary treatment process prior to flour milling will be described with reference to the flow chart of FIG. 6.

Cleaned raw wheat X which has been obtained by removing foreign particles in the row material and with a water content of approximately 11 to 12% by weight, is fed to a water additioner 90 to add an amount of water necessary to make the water content to approximately 16 to 17% by weight, followed by keeping it in a tempering tank 91 for a predetermined period of time. The keeping time is suitably about 6 hours in the case of duram wheat or the like and at most about 48 hours in the case of hard wheat. As a result of this tempering, tempered wheat Y with the grain inside thereof permeated by water is obtained. This tempered wheat is then pearled in a pearling process 92 with a plurality of vertical pearling machines as illustrated connected in tandem. Prior to the pearling, water is added by a water additioner 93, and the water content is increased by 1 to 2 points by weight in a keeping tank 94. The keeping time is a couple of minutes, and permeation of water content proceeds only in the surface layer part of the grains.

The tempered wheat thus prepared is then pearled in the pearling process 92 with three pearling machines 1 connected in tandem. The pearling function in the first pass will now be described with reference to FIGS. 2 and 3. The wheat charged into the feed hopper 15 is fed by the feed screw 12 from the feed port 9 into the feed cylinder 9 and, then, it is fed upward into the pearling chamber 56 by the feeding functions of the screw roll 7 and the auxiliary screw roll 30. In the pearling chamber 56, the wheat is pearled as it is brought into contact with the periphery of the abrasivestones 31 in the abrasive type pearling rolls 29*a*. The pearling chamber 56 is a nine-sided cylindrical space, and very active stirring action is produced by the resistance bars 23 provided at nine positions of the bran removal cylinder 20 and the stirring bars 40 provided at three positions of the abrasive type pearling roll assembly 29. Thus, the spinning and revolution of the grains are promoted, and an entire surface of each grain is pearled uniformly.

The wheat grains which are rising through the pearling chamber 56 while receiving the pearling action, reach a peripheral portion of the upper rotary cylinder 54 to be discharged from the discharge port 50 into the discharging chute 51 by the pawls 55 provided on the periphery of the rotary cylinder 54. At this time, the wheat grains receive resistance offered by the biasing force of the resistance plate 53 directed toward the discharge port 50, and thus the interior of the pearling chamber 56 is held under an adequate pressure while the pearling function is in progress.

Meanwhile, external air flows through the perforated cover 49 into the upper rotary cylinder 54 with a withdrawal force provided by the fan connected to the outside of the bran duct 68, and it flows down from the opening 46*a* of the retainer plate 46 through the space defined by the arms 34, rim 32 and boss 33 in each abrasive type pearling roll 29*a*. Then it flows through the spaces between adjacent arms 37 of the air blowing spacer 35 to be blown through the air blow port 38 into the pearling chamber 56. The bran particles which have been cut out from the wheat grains are carried along with air through the bran removal wall 20*a* into the bran removal chamber 63. These bran particles are then led through the bran discharge port 67 into the bran duct 68 by the action of the vanes 66 in the bran collection chamber 70.

The wheat grains which are discharged from the discharging chute 51 are given water again in the water additioner 95 and then kept in the keeping tank 96 for a couple of minutes. This is done so for making up for lost water content in the surface portion in the first pass of pearling and thus facilitating the pearling in the subsequent stage.

Figure 5:
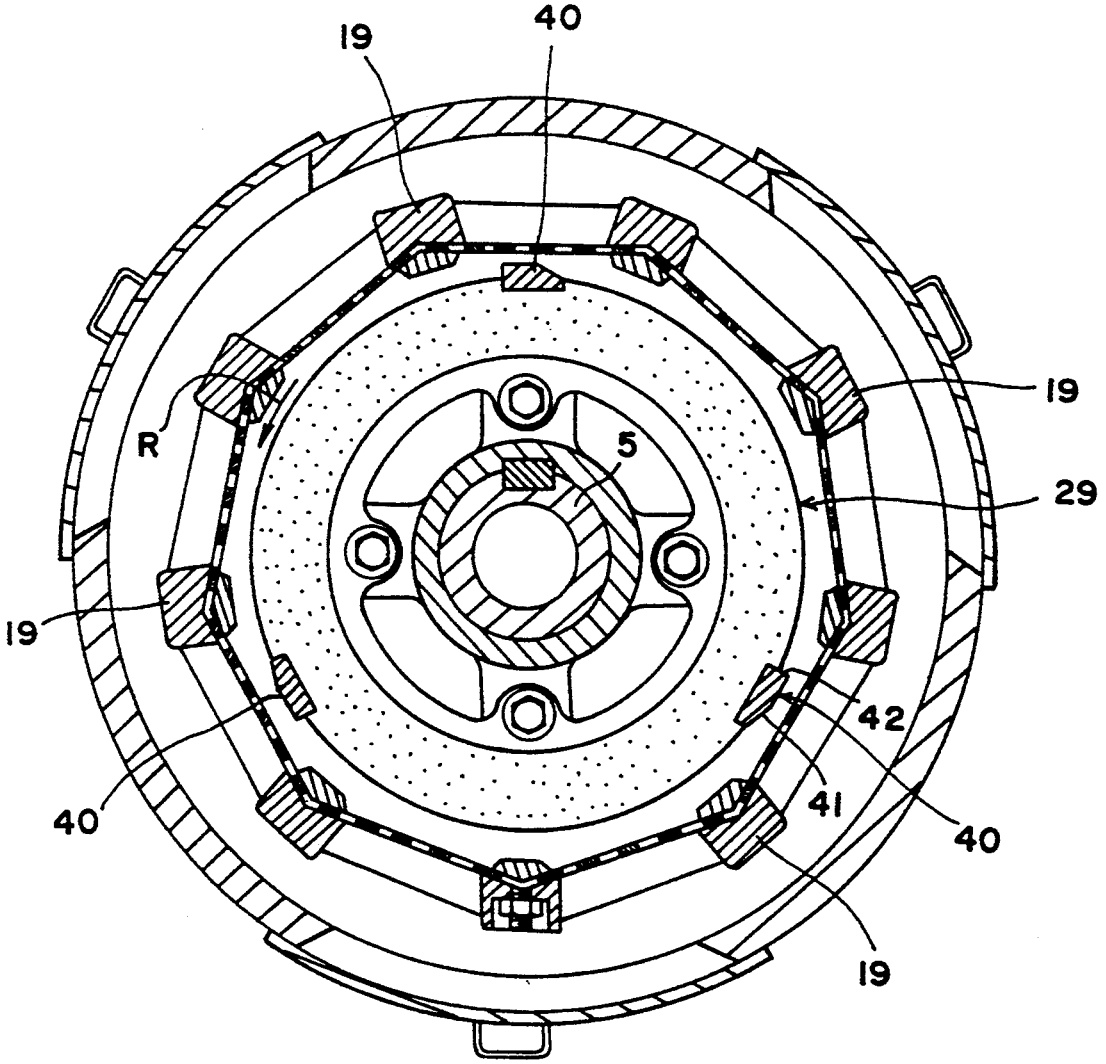
FIG. 5 is a sectional view taken along a line A—A in FIG. 2 showing the pearling machine with stirring bars mounted upside down.

Now, the second pass of the pearling operation will be described with reference to FIGS. 4 and 5. The second pass is carried out with the same pearling machine 1 as the first pass. In the vertical pearling machine used in this pass, the stirring bars 40 are secured upside down relative to the first pass, and they are fitted in the grooves 39 as such. Thus, as noted before, the rising portion 42 is found forward in the rotational direction R of the pearling roll assembly 29. Thus, compared to the pearling machine for the first pass the stirring action is promoted to permit more active spinning and revolution of the wheat grains, and the surface layer of the wheat grains having been softened by adding water thereto is uniformly cut off by the periphery of the abrasivestones 31. Further, as shown in FIG. 4, it is possible to fit each stirring bar 40 in each groove 39 via a strip-like spacer 80 and secure each resistance bar 23 to each support post 19 via a bent strip spacer 81 corresponding to the hill-like portion 22 of the resistance bar 23. In this case, the resistance function and stirring function are enhanced, and in the pearling of grains with the abrasive type pearling roll assembly 29 a frictional system pearling action can also be realized. Further, it is possible, in place of the provision of the spacers 80 and 81, to prepare replacement stirring and resistance bars 40 and 23 with the thicknesses thereof increased in correspondence to the thicknesses of the spacers and use these replacement stirring and resistance bars as desired.

The third pass has substantially the same effects as the second path. As a result, the bran of the grains is removed to obtain pearled wheat Z with a water content of approximately 16% by weight.

While the above embodiment has concerned with only the illustrated pearling machine of the commonly termed upward feed type with the pearling chamber 56 provided with the grain feed port 9 at a lower position and the grain discharge port 50 at an upper position, substantially the same pearling function is of course obtainable with a pearling machine of flow-down type, in which grain feed means is provided at an upper position and the grain discharge means at a lower position so that the grains are fed from the upper position and discharged from the lower position. Further, it is possible to divide each stirring bar 40 into divisions and secure these divisions to the individual pearling rolls 29*a* in a progressively staggered fashion.

As has been described in the foregoing, with the pearling machine according to the invention, by the cooperative action of the resistance bars provided axially on the polygonal bran removal cylinder surface and the stirring bars provided vertically on the periphery of the abrasive type pearling roll assembly comprising a plurality of rolls, the grains in the pearling chamber are adequately stirred to actively undergo spinning and revolution and strike the pearling roll periphery in multiple directions and highly frequently so as to receive uniform cutting action. It is thus possible to obtain uniform pearling of each grain and the whole process material.

Further, by fitting each of the stirring bars such that its chamfer is found on the forward side in the rotational direction of the pearling roll assembly and its rising portion on the other side, a comparatively gentle stirring action is obtainable, while by fitting the stirring bar upside down the rising portion is found on the forward side in the rotational direction to obtain a more active stirring action. Thus, with the pearling machine according to the invention, by suitably setting the vertical relation of the stirring bars in the use of a plurality of the pearling machines according to the invention connected in tandem, it is possible to selectively obtain the pearling function of the abrasive system with a comparatively gentle stirring action and the pearling function of the frictional system with an active stirring action with the same pearling machine.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. A vertical pearling machine comprising:

a vertical polygonal bran removal cylinder including a plurality of support posts and bran removal walls each stretched between adjacent ones of said support posts;

an abrasive type pearling roll assembly mounted on an upper portion of a main shaft erected rotatably within said vertical polygonal bran removal cylinder and having an outer periphery whose section is in a circular profile;

a grain feeding means connected to one end of a pearling chamber defined between said vertical polygonal bran removal cylinder and said pearling roll assembly; and a grain discharging means connected to the other end of said pearling chamber, said abrasive type pearling roll assembly including a plurality of abrasive type pearling rolls stacked one over another with air blowing spacers being interposed therebetween, and stirring bars provided on an outer periphery of each of said abrasive type pearling rolls and projecting into said pearling chamber, and said bran removal cylinder having, on an inner surface thereof, resistance bars projecting into said pearling chamber.

2. The vertical pearling machine according to claim 1, wherein said abrasive type pearling rolls have axial grooves formed in their outer periphery, said stirring bars being mounted in said axial grooves, respectively.

3. The vertical pearling machine according to claim 1, wherein each of said stirring bars has a chamfer formed on one of forward and rearward sides in the rotational direction of said abrasive type pearling roll assembly and also has a rising portion on the other side.

4. The vertical pearling machine according to claim 1, wherein each of said stirring bars is secured by bolts to an outer peripheral surface of each of said air blowing spacers.

5. The vertical pearling machine according to claim 1, wherein each of said stirring bars is mounted, via a spacer having a predetermined thickness, in each of said axial groove provided in each of said abrasive type pearling rolls.

6. The vertical pearling machine according to claim 1, wherein each of said stirring bars has a length corresponding to an entire length or axial dimension of said abrasive type pearling roll assembly and is secured to the same assembly via each axial groove formed in each said abrasive type pearling roll at a corresponding position.

7. The vertical pearling machine according to claim 1, wherein each of said resistance bars has a length corresponding to an entire length or axial dimension of said abrasive type pearling roll assembly and is secured to each of said support posts of said vertical polygonal bran removal cylinder such that adjacent edges of corresponding ones of said bran removal walls are clamped between said resistance bar and said support post.

8. The vertical pearling machine according to claim 1, wherein each of said resistance bars is secured to each of said support posts of said vertical polygonal bran removal cylinder via a spacer having a predetermined thickness.

9. The vertical pearling machine according to claim 1, wherein each of said air blowing spacers has a boss mounted on said main shaft and a plurality of arms extending radially from said boss, said arms each being bent rearwardly in the rotational direction of said abrasive type pearling roll assembly.

10. The vertical pearling machine according to claim 1, wherein said grain feeding means and said grain discharging means are provided in correspondence to a lower and an upper portion of said pearling chamber, respectively, thereby forming a pearling machine of upward feed type.

11. The vertical pearling machine according to claim 1, wherein said grain feeding means and said grain discharging means are provided in correspondence to an upper and a lower portion of said pearling chamber, respectively, thereby forming a pearling machine of flow-down type.

12. An apparatus for preliminary treatment prior to flour milling using a plurality of vertical pearling machines connected in tandem, each of said vertical pearling machines comprising:

a vertical polygonal bran removal cylinder having a plurality of support posts, bran removal walls each stretched between adjacent ones of said support posts, and resistance bars each secured to each said support post along a borderline between adjacent said bran removal walls so as to project into a pearling chamber; and an abrasive type pearling roll assembly rotatably mounted on an upper portion of a main shaft rotatably erected in said vertical polygonal bran removal cylinder, said abrasive type pearling roll assembly having an abrasivestone provided over an entire circumference, having an outer periphery of a circular sectional profile and being formed by stacking a plurality of abrasive type pearling rolls with air blowing spacers being interposed therebetween, each of said abrasive type pearling roll having, in an outer periphery thereof, a plurality of axial grooves, said abrasive type pearling roll assembly including stirring bars each being mounted in each of said axial grooves and secured so as to project into said pearling chamber.

13. The apparatus for preliminary treatment prior to flour milling according to claim 12, wherein each of said stirring bars has a chamfer formed on one of forward and rearward sides in the rotational direction of said abrasive type pearling roll assembly and a rising portion formed on the other side.

14. The apparatus for preliminary treatment prior to flour milling according to claim 13, wherein said stirring bars of some of said plurality of pearling machines have said rising portions formed on the forward side in the rotational direction of said abrasive type pearling roll assembly.

* * * * *